US006863740B2

(12) United States Patent
Moriyama et al.

(10) Patent No.: US 6,863,740 B2
(45) Date of Patent: Mar. 8, 2005

(54) CLEANING METHOD OF CERAMIC MEMBER

(75) Inventors: Shirou Moriyama, Sendai (JP); Hiroshi Hatakeyama, Sendai (JP); Hiromichi Ohtaki, Sendai (JP)

(73) Assignee: Nihon Ceratec Co., Ltd., Miyagi-pref (JP)

( * ) Notice: Subject to any disclaimer, the term of this patent is extended or adjusted under 35 U.S.C. 154(b) by 0 days.

(21) Appl. No.: 10/851,862

(22) Filed: May 20, 2004

(65) Prior Publication Data

US 2004/0231705 A1 Nov. 25, 2004

(30) Foreign Application Priority Data

May 21, 2003 (JP) ..... 2003-143861

(51) Int. Cl.[7] ..... B08B 3/00

(52) U.S. Cl. ..... 134/26; 134/1; 134/2; 134/19; 134/22.1; 134/22.12; 134/22.13; 134/22.14; 134/22.17; 134/22.18; 134/22.19; 134/28; 134/29; 134/30; 134/34; 134/35; 134/36

(58) Field of Search ..... 134/1, 2, 19, 22.1, 134/22.12, 22.13, 22.14, 22.17, 22.18, 22.19, 26, 28, 29, 30, 34, 35, 36

(56) References Cited

U.S. PATENT DOCUMENTS 3,033,710 A * 5/1962 Hightower et al. ..... 134/1
4,713,119 A * 12/1987 Earhart et al. ..... 134/3
5,837,662 A * 11/1998 Chai et al. ..... 510/175
6,165,279 A * 12/2000 Tsao et al. ..... 134/3
6,230,720 B1 * 5/2001 Yalamanchili et al. ..... 134/1.3
2004/0045574 A1 * 3/2004 Tan ..... 134/1
2004/0060579 A1 * 4/2004 Kim et al. ..... 134/28

FOREIGN PATENT DOCUMENTS

JP 2003-55070 A 2/2003
JP 2003-055070 * 2/2003

* cited by examiner

*Primary Examiner*—Sharidan Carrillo
(74) *Attorney, Agent, or Firm*—Frishauf, Holtz, Goodman & Chick, P.C.

(57) ABSTRACT

Disclosed is a cleaning method of a ceramic member, which permits removing with a high accuracy the contaminants from a ceramic member contaminated with the contaminant. The cleaning method comprises the steps of processing the contaminated ceramic member with an alkaline chemical liquid having a pH value not smaller than 10 in the presence of an ultrasonic wave, processing the ceramic member processed with the alkaline chemical liquid with a prescribed acidic chemical liquid in the presence of an ultrasonic wave, and heating the ceramic member processed with the acidic chemical liquid under temperatures not lower than 1,000° C.

2 Claims, No Drawings

CLEANING METHOD OF CERAMIC MEMBER

BACKGROUND OF THE INVENTION

1. Field of the Invention

The present invention relates to a cleaning method of a ceramic member.

2. Description of the Related Art

In general, a ceramic member is processed by, for example, a diamond tool in the final stage of the manufacturing process. In the process stage with the diamond tool, the debris accompanying the processing, the diamond abrasive grains, etc. (hereinafter referred to as an "extraneous material") are attached to the surface of the ceramic member, with the result that various detrimental effects are generated during use of the ceramic member. Particularly, where the ceramic member is used in the manufacturing process of a semiconductor device or in the manufacturing process of a liquid crystal display device, it is possible for the extraneous materials to be attached to the semiconductor wafer or to the liquid crystal substrate as particles so as to give rise to defects. Such being the situation, it is necessary to completely remove in advance the extraneous materials attached to the ceramic member.

It should also be noted that it is absolutely necessary in recent years to employ the process step using a highly corrosive fluorine series or chlorine series gas or a plasma in the manufacturing process of a semiconductor device or in the manufacturing process of a liquid crystal display device. Particularly, in the manufacturing process of a semiconductor device, these corrosive gases or the plasma are frequently used in the steps of, for example, the chemical vapor deposition (CVD), the dry etching and the cleaning of the chamber. Under the circumstances, the members exposed to the corrosive gas atmosphere or to the plasma atmosphere during the process steps noted above are required to exhibit a high corrosion resistance to the corrosive gas and the plasma. In compliance with the requirement, a ceramic material such as an alumina sintered body, sapphire or an aluminum nitride sintered body is used for forming the members which are to be exposed to the corrosive gas atmosphere or to the plasma atmosphere.

However, even in the case of using such a ceramic member under the corrosive gas atmosphere or under the plasma atmosphere, a chemical reaction is generated between the ceramic member and the corrosive gas or the plasma, with the result that the surface of the ceramic member is contaminated with the reaction product. The reaction product noted above is present on the surface of the ceramic member as particles, or the particular reaction product is directly formed on the surface of the ceramic member. Since the reaction product in question renders the plasma state unstable or causes the semiconductor device, which is being manufactured, to be contaminated, it is necessary to remove the reaction product appropriately.

A chemical method is employed for removing the extraneous materials attached to the surface of the ceramic member in the manufacturing stage of the ceramic member. To be more specific, the ceramic member is cleaned with a chemical liquid for removing the extraneous materials by allowing the extraneous materials to be dissolved in the chemical liquid. On the other hand, for removing the reaction product formed by the reaction between the ceramic member and the corrosive gas or the like, which contaminates the ceramic member during the manufacturing process of the semiconductor device or the liquid crystal display device, employed is a physical method in which the reaction product in question is physically removed by polishing the surface of the ceramic member or a chemical method in which the particular reaction product is removed by allowing the reaction product to be dissolved in a chemical liquid. Japanese Patent Disclosure (Kokai) No. 2003-55070 discloses a chemical method of removing the extraneous materials and the reaction product which are hereinafter referred to as a "contaminant". It is taught that a ceramic member contaminated with the contaminants is processed with an alkaline chemical liquid and, then, with an acidic chemical liquid, followed by applying a prescribed heat treatment to the ceramic member.

However, a rapid progress is being made in recent years in, for example, the semiconductor device in respect of the miniaturization of the circuit pattern and the degree of integration. As a result, the ceramic member, which is satisfactory when used in the manufacturing process of the conventional semiconductor device, brings about a difficulty when used in the manufacturing process of the latest semiconductor device. In other words, a difficulty is generated even in the case where the amount of the contaminants remaining on the ceramic member is lowered to reach such a low level as not to give detrimental effects to the manufactured semiconductor device when the ceramic member is used in the manufacturing process of the conventional semiconductor device. To be more specific, it is possible for the contaminants attached to the ceramic member to bring about inconveniences when the ceramic member is used in the manufacturing process of the latest semiconductor device. For example, it is possible for the yield of the manufactured latest semiconductor device to be lowered. Under the circumstances, it is of high importance to develop a cleaning method that permits removing with a higher accuracy the contaminants attached to the surface of the ceramic member so as to further decrease the residual amount of the contaminants.

BRIEF SUMMARY OF THE INVENTION

An object of the present invention is to provide a cleaning method of a ceramic member that permits removing with a high accuracy the contaminants from the ceramic member.

According to the present invention, there is provided a cleaning method of a ceramic member having a contaminated surface, comprising the steps of:

processing the ceramic member with an alkaline chemical liquid having a pH value not smaller than 10 in the presence of an ultrasonic wave;

processing the ceramic member processed with the alkaline chemical liquid with a prescribed acidic chemical liquid in the presence of an ultrasonic wave; and heating the ceramic member processed with the acidic chemical liquid under temperatures not lower than 1,000° C.

It is desirable for the alkaline chemical liquid used in the cleaning method of the present invention for cleaning the ceramic member to contain an alkali metal, an organic acid, a glycol series solvent, a surfactant, and pure water. Also, it is desirable for the cleaning method of the present invention to further comprise the step of cleaning the ceramic member with pure water after the processing with the alkaline chemical liquid and before the processing with the acidic chemical liquid.

The cleaning method of the ceramic member according to the present invention permits removing with a high accuracy from the surface of the ceramic member the extraneous materials attached to the ceramic member during the manufacturing process of the ceramic member. The cleaning method of the present invention also permits removing the reaction product or the like formed on the surface of the ceramic member when the ceramic member is actually used under a prescribed environment in the manufacturing process of, for example, a semiconductor device. It follows that, in the case of using the ceramic member, which is subjected to the cleaning by the method of the present invention, as a prescribed member included in the manufacturing apparatus of, for example, the semiconductor device, it is possible to increase the yield and quality of the manufactured semiconductor device.

DETAILED DESCRIPTION OF THE INVENTION

The present invention will now be described in detail. In the method of the present invention for cleaning a ceramic member, a contaminated ceramic member is processed with an alkaline chemical liquid having a pH value not smaller than 10 in the presence of an ultrasonic wave, followed by processing the ceramic member processed with the alkaline chemical liquid with an acidic chemical liquid in the presence of an ultrasonic wave. Further, the ceramic member processed with the acidic chemical liquid is heated under temperatures not lower than 1,000° C.

The material, use, etc. of the ceramic member to which the present invention is applied are not particularly limited. For example, the specific examples of the ceramic members handled in the present invention include parts of the apparatus for manufacturing a semiconductor device such as a focus ring, an electrostatic chuck, a wafer transfer hand, a chamber dome and a clamp ring, parts of the apparatus for manufacturing the liquid crystal display device such as a mask plate, as well as an insulator and true spherical beads.

The contaminated ceramic member handled in the present invention denotes the ceramic member having a extraneous material attached to the surface thereof, or the ceramic member having at least a part of the surface having a composition differing from the inherent composition of the ceramic member. To be more specific, the contaminated ceramic members handled in the present invention include, for example, a ceramic member having a cutting debris or abrasive particles attached to the surface during the manufacturing process of the ceramic member, a ceramic member having the surface chemically changed by the use of the ceramic member under a prescribed environment, for example, a corrosive environment, so as to have a reaction product formed by the reaction between the ceramic member and the corrosive environment, the reaction product being attached as particles to the surface of the ceramic member or being directly formed on the surface of the ceramic member, and a ceramic member having a particles physically attached to the surface thereof during use of the ceramic member under a prescribed environment.

The first process of cleaning the ceramic member with an alkaline chemical liquid is mainly intended to dissolve the stains of the fat and oil and organic materials attached to the surface of the ceramic member. A chemical liquid containing an alkali metal, an organic acid, a glycol series solvent, a surfactant, and pure water (ion-exchange water) is suitably used as the alkaline chemical liquid. To be more specific, potassium, which is generated by dissolving potassium hydroxide in pure water, is used as the alkali metal. The organic acids contained in the alkaline chemical liquid include, for example, citric acid, gluconic acid, and edetic acid. Ethylene glycol is suitably used as the glycol series solvent contained in the alkaline chemical liquid. Nonionic surfactant such as polyoxyethylene alkyl ether is suitably used as the surfactant. In order to enable the alkaline chemical liquid to exhibit a strong capability of dissolving, for example, the stains of fat and oil, the alkaline chemical liquid should have a pH value not smaller than 10. Also, the cleaning process with the alkaline chemical liquid is carried out in the presence of an ultrasonic wave so as to enhance the cleaning capability.

The process of cleaning the ceramic member with an acidic chemical liquid, which is carried out in the next step, is intended to remove the metal present on the surface of the ceramic member. It suffices to select appropriately the acidic chemical liquid in accordance with the kind of the metal attached to the surface of the ceramic member such that the attached metal can be effectively removed by the cleaning with the acidic chemical liquid. To be more specific, it is possible to use, for example, nitric acid, hydrofluoric acid, aqua regia, sulfuric acid, and a mixture of acetic acid and hydrofluoric acid as the acidic chemical liquid, though the acidic chemical liquid used in the present invention is not limited to the liquids exemplified above. In order to enhance the cleaning capability, the cleaning process with the acidic chemical liquid is also carried out in the presence of an ultrasonic wave.

After the cleaning process with the acidic chemical liquid, a heat treatment is applied to the ceramic member. The heat treatment is mainly intended to remove by vaporization (evaporation) or decomposition the contaminants such as the extraneous materials and the reaction product, which are left attached to the surface of the ceramic member after the processing with the acidic chemical liquid. The heat treatment is carried out by putting the ceramic member in, for example, an electric furnace, a gas furnace or a micro wave heating furnace for allowing the ceramic member to be left to stand under temperatures not lower than 1,000° C. for a prescribed time. Under temperatures lower than 1,000° C., the removal of the contaminants remaining on the surface of the ceramic member tends to be rendered insufficient.

Incidentally, the upper limit of the temperatures for the heat treatment is not particularly specified in the present invention. However, in order to prevent the ceramic member from being deformed or deteriorated during the heat treatment, the temperature for the heat treatment should be practically not higher than the sintering temperature employed in the manufacturing process of the ceramic member in the case where the ceramic member is formed of a sintered body, or should be not higher than the melting point of the ceramic member in the case where the ceramic member is formed of a single crystal body.

It is also possible to employ a plasma processing as the heat treatment. To be more specific, the contaminants attached to the ceramic member are removed by allowing a plasma to act on the ceramic member so as to heat the ceramic member. In this case, it is naturally necessary to select appropriately the atmosphere gas in order to prevent the ceramic member from being contaminated again by the plasma atmosphere.

In the cleaning method of the ceramic member specified in the present invention, the number of times of the cleaning process with an alkaline chemical liquid is not particularly limited. It is possible to carry out the cleaning process with the alkaline chemical liquid a plurality of times. In this case, it is desirable to process, for example, a contaminated ceramic member with an alkaline chemical liquid that was already used a large number of times and, then, with an alkaline chemical liquid that was already used a small number of times and, finally, with a fresh alkaline chemical liquid. This is also the case with the cleaning process with an acidic chemical liquid. It is also possible to carry out alternately the cleaning process with an alkaline chemical liquid and the cleaning process with an acidic chemical liquid. Further, it is also possible to carry out alternately the cleaning process with an alkaline chemical liquid, the cleaning process with an acidic chemical liquid, and the heat treatment.

Further, it is desirable to carry out the cleaning process of the ceramic member with pure water (water wash) after the cleaning process with the alkaline chemical liquid so as to wash away sufficiently the alkaline chemical liquid attached to the surface of the ceramic member, followed by performing the cleaning process with an acidic chemical liquid. It should be noted in this connection that, if the alkali metal component is left unremoved on the ceramic member, it is possible for the remaining alkali metal component to contaminate the environment of the manufacturing process of, for example, a semiconductor device in the case where the ceramic member is arranged in the apparatus for manufacturing the semiconductor device. Such being the situation, in order to prevent the above-noted difficulty, it is important to carry out the water wash of the ceramic member after the cleaning process with the alkaline chemical liquid for washing away the alkaline chemical liquid attached to the surface of the ceramic member. It should also be noted that, if the remaining alkaline chemical liquid is removed by the water wash noted above, it is possible to prevent the neutralization reaction from being carried out between the alkaline chemical liquid and the acidic chemical liquid. It follows that it is possible to prevent the cleaning capability of the acidic chemical liquid from being lowered and to prevent the acidic chemical liquid from being contaminated.

Further, it is also desirable to carry out the cleaning process with pure water after the cleaning process with the acidic chemical liquid. If the water wash of the ceramic member is not performed after the cleaning process with the acidic chemical liquid, it is possible for the acid component to be left unremoved on the surface of the ceramic member. In this case, the remaining acid component is evaporated during the heat treatment applied in the subsequent step and, thus, it is possible for the furnace used for the heat treatment to be contaminated with the evaporated acid component. In other words, the water wash performed after the cleaning process with the acidic chemical liquid makes it possible to prevent the furnace used for the subsequent heat treatment from being contaminated. Further, it is desirable to wash the ceramic member with pure water after the heat treatment applied to the ceramic member. Where extraneous materials derived from, for example, the heat insulating material used in the furnace are attached to the ceramic member during the heat treatment, these particles or the like can be removed from the ceramic member by the water wash.

To reiterate, extraneous materials are attached to the surface of a ceramic member during the manufacturing process of the ceramic member. Also, a reaction product is formed on the surface of the ceramic member when the ceramic member is actually used under a prescribed environment, e.g., a corrosive atmosphere. However, if the ceramic member is cleaned by the cleaning method of the present invention described above, the contaminants such as the extraneous materials and the reaction product formed on the surface of the ceramic member can be removed with a high accuracy so as to markedly decrease the residual amount of the contaminants present on the surface of the ceramic member.

Table 1 shows the plasma processing conditions, the cleaning process conditions for the cleaning process with an alkaline chemical liquid and with an acidic chemical liquid, the temperature for heating, and the results of the cleaning process, covering the case where a ceramic member formed of an alumina sintered body, i.e., $Al_2O_3$ as shown in Table 1, or a single crystal alumina, i.e., sapphire as shown in Table 1, which was processed under a plasma atmosphere, was subjected to a prescribed cleaning process. Examples 1 to 9 shown in Table 1 are directed to the cleaning process carried out within the technical scope of the present invention, and Comparative Examples 1 to 5 shown in Table 1 cover the case where the cleaning process was carried out under the conditions failing to fall within the technical scope of the present invention. Here, the alkaline chemical liquid was prepared by dissolving potassium hydroxide, citric acid, ethylene glycol and polyoxyethylene alkyl ether in pure water to have a composition shown in Table 1. The acidic chemical liquid containing 1.0% by weight of nitric acid and 0.2% by weight of hydrofluoric acid was used. The cleaning process with the alkaline chemical liquid and the cleaning process with the acidic chemical liquid were carried out in the presence of the ultrasonic wave by using the ultrasonic cleaning apparatus S8540 from Branson Ultrasonic Corporation, with the frequency of 40 kHz and the output power of 1000 W.

TABLE 1

| | | Ceramic Member | | | Conditions for Cleaning Process of Ceramic Member | | | | | | |
|---|---|---|---|---|---|---|---|---|---|---|---|
| | | | | | Alkaline Chemical Liquid | | | | | | |
| | | Material | Apparatus | Gas Used | Potassium Hydroxide | Citric Acid | Ethylene Glycol | Polyoxyethylene Alkyl Ether | pH | Cleaning with Ultrasonic Wave | Cleaning with Pure Water *1 |
| Example | 1 | $Al_2O_3$ | Etching Apparatus | Fluorine Series | 0.7% | 0.7% | 0.7% | 1.5% | 11 | Cleaned | Cleaned |
| | 2 | $Al_2O_3$ | Etching Apparatus | Fluorine Series | 0.5% | 0.7% | 0.7% | 1.5% | 10 | Cleaned | Cleaned |
| | 3 | $Al_2O_3$ | CVD Apparatus | Chlorine Series | 0.5% | 0.7% | 0.7% | 1.5% | 10 | Cleaned | Cleaned |
| | 4 | $Al_2O_3$ | CVD | Chlo- | 0.7% | 0.7% | 0.7% | 1.5% | 11 | Cleaned | Cleaned |

TABLE 1-continued

| | | | | | | | | | | | |
|---|---|---|---|---|---|---|---|---|---|---|---|
| | | | Apparatus | rine Series | | | | | | | |
| | 5 | Sapphire | Etching Apparatus | Fluorine Series | 0.5% | 0.7% | 0.7% | 1.5% | 10 | Cleaned | Cleaned |
| | 6 | $Al_2O_3$ | Etching Apparatus | Fluorine Series | 0.9% | 0.7% | — | 1.5% | 12 | Cleaned | Cleaned |
| | 7 | $Al_2O_3$ | Etching Apparatus | Fluorine Series | 0.7% | — | 0.7% | 1.5% | 11 | Cleaned | Cleaned |
| | 8 | $Al_2O_3$ | Etching Apparatus | Fluorine Series | 0.7% | — | — | 1.5% | 11 | Cleaned | Cleaned |
| | 9 | $Al_2O_3$ | Etching Apparatus | Fluorine Series | 0.5% | 0.7% | 0.7% | 1.5% | 10 | Cleaned | None |
| Comparative Example | 1 | $Al_2O_3$ | Etching Apparatus | Fluorine Series | 0.3% | 0.7% | 0.7% | 1.5% | 9 | Cleaned | Cleaned |
| | 2 | $Al_2O_3$ | Etching Apparatus | Fluorine Series | 0.5% | 0.7% | 0.7% | 1.5% | 10 | Cleaned | Cleaned |
| | 3 | $Al_2O_3$ | Etching Apparatus | Fluorine Series | 0.7% | 0.7% | 0.7% | 1.5% | 11 | None | Cleaned |
| | 4 | $Al_2O_3$ | Etching Apparatus | Fluorine Series | 0.7% | 0.7% | 0.7% | 1.5% | 11 | Cleaned | Cleaned |
| | 5 | $Al_2O_3$ | Etching Apparatus | Fluorine Series | 0.7% | 0.7% | 0.7% | 1.5% | 11 | Cleaned | Cleaned |

| | | Conditions for Cleaning Process of Ceramic Member | | | Result of Evaluation | | | | |
|---|---|---|---|---|---|---|---|---|---|
| | | Cleaning with Acidic Chemical Liquid *2 | | | | | | | |
| | | Cleaning | Cleaning with Ultrasonic Wave | Temp. for Heating (° C.) | Removal of Contaminants *3 | Result of Analysis (%) F | Cl | Metal *4 | Colored Dots |
| Example | 1 | Cleaned | Cleaned | 1000 | ⊙ | 0.0 | — | 0.0 | None |
| | 2 | Cleaned | Cleaned | 1300 | ⊙ | 0.0 | — | 0.0 | None |
| | 3 | Cleaned | Cleaned | 1100 | ⊙ | — | 0.0 | 0.0 | None |
| | 4 | Cleaned | Cleaned | 1300 | ⊙ | — | 0.0 | 0.0 | None |
| | 5 | Cleaned | Cleaned | 1300 | ⊙ | 0.0 | — | 0.0 | None |
| | 6 | Cleaned | Cleaned | 1000 | Δ | 0.0 | — | 0.0 | None |
| | 7 | Cleaned | Cleaned | 1000 | Δ | 0.0 | — | 0.0 | None |
| | 8 | Cleaned | Cleaned | 1300 | Δ | 0.0 | — | 0.0 | None |
| | 9 | Cleaned | Cleaned | 1000 | ○ | 0.0 | — | 0.0 | None |
| Comparative Example | 1 | Cleaned | Cleaned | 1000 | x | 1.0 | — | 0.0 | None |
| | 2 | Cleaned | Cleaned | 850 | x | 1.0 | — | 0.0 | None |
| | 3 | Cleaned | Cleaned | 1000 | x | 1.0 | — | 1.0 | Found |
| | 4 | None | None | 1000 | ⊙ | 0.0 | — | 3.0 | Found |
| | 5 | Cleaned | None | 1000 | ⊙ | 0.0 | — | 2.0 | Found |

*1 Cleaning with Pure Water after Cleaning with Alkaline Chemical Liquid
*2 Acidic Chemical Liquid contains 1.0% by weight of Nitric Acid and 0.2% by weight of Hydrofluoric Acid.
*3 Visual Observation
Complete Removal of Contaminants: ⊙, Removal of Contaminants and Slight Change in Color Tone: ○, Removal of Contaminants and Change in Color Tone: Δ, Contaminants Left Unremoved: x
*4 Metal: Sum of Fe, Ni, Cr, Cu and Alkali Metal As shown in Table 1, the ceramic member for each of Examples 1, 2, 6 to 9 and Comparative Examples 1 to 5 was an alumina sintered body member used in an etching apparatus and exposed to a fluorine series gas plasma atmosphere for a prescribed time. Also, the ceramic member for Example 5 was a sapphire member processed under the conditions equal to those for Example 2. Further, the ceramic member for each of Examples 3 and 4 was an alumina sintered body member used in a CVD apparatus and exposed to a chlorine series gas plasma atmosphere for a prescribed time. It should be noted that the cleaning process with the acidic chemical liquid after the plasma processing was carried out by using an aqueous solution containing at least one of hydrofluoric acid, nitric acid and sulfuric acid having hydrogen peroxide added thereto, and the heat treatment after the cleaning process with the acidic chemical liquid was carried out under the air atmosphere by using an electric furnace for each of the samples for Examples 1 to 9 and Comparative Examples 1 to 5, though the conditions for the cleaning process with the acidic chemical liquid and for the heat treatment after the cleaning process with the acidic chemical liquid are not given in Table 1.

Concerning the evaluation of the ceramic member after the cleaning process, the state of removal of the contaminant from the surface of the ceramic member and the generation of colored dots were evaluated by the visual observation with an optical microscope. Also, the surface analysis for determining the amounts of fluorine, chlorine and metal components (Fe, Ni, Cr, Cu, alkali metal) was performed by the X-ray photoelectron spectroscopy (ESCA: Model 5400MC manufactured by Perkin-Elmer Corp.). Incidentally, the colored dot denotes a defect generated by traces of Fe, Ni, Cr, etc. which are left unremoved on the surface of the ceramic member.

As apparent from Table 1, the ceramic member for each of Examples 1 to 5 was found to be satisfactory in the state of removal of the contaminants, which was evaluated by the visual observation. Also, the colored dot was not recognized, and any of fluorine, chlorine and the metal component was not detected in any of the ceramic members for these Examples. The experimental data support that the state after the cleaning process was most satisfactory in the ceramic member for each of Examples 1 to 5. In each of Examples 6 to 8, the contaminant was evaluated by the visual observation as having been removed, though a change in color tone was seemingly observed on the substrate after removal of the contaminant. However, since the metal component or the like was not detected by the analysis by ESCA applied to the portion where the change in color tone was observed, it is practically possible to use again the ceramic member in the etching apparatus. In other words, the ceramic members for Examples 6 to 8 were evaluated as being practically free from problems in quality. Likewise, a portion where the color tone was seemingly changed was observed in Example 9 on the substrate after removal of the attached material, though the degree of change in the color tone was lower than that for Examples 6 to 8. In other words, the ceramic member for Example 9 was evaluated as being free from a practical problem.

On the other hand, it was found by the visual observation that the extraneous material was left unremoved on the surface of the ceramic member for each of Comparative Examples 1 to 3. In addition, the fluorine component was detected from these ceramic members. Also, the colored dot derived from the metal component remaining on the surface of the ceramic member was recognized in the ceramic member for Comparative Example 3. The extraneous material and the fluorine component were certainly removed from the ceramic members for Comparative Examples 4 and 5. However, the colored dot caused by the metal component remaining on the surface of the ceramic member was confirmed in the ceramic members for these Comparative Examples 4 and 5. Such being the situation, the ceramic members for Comparative Examples 1 to 5 were evaluated as being undesirable for re-use in the etching apparatus.

As pointed out above, it has been confirmed that the cleaning method of the ceramic member defined in the present invention permits removing with a high accuracy the contaminants from the ceramic member contaminated with the contaminants.

It should be noted that the embodiments described above are simply intended to clarify the technical idea of the present invention. Naturally, the technical scope of the present invention should not be construed solely on the basis of the specific embodiments described above. In other words, the present invention can be worked in variously modified fashions on the basis of the spirit of the present invention and within the scope defined in the accompanying claims.

What is claimed is:

1. A method of cleaning a ceramic member having a contaminated surface, comprising the steps of:

cleaning the ceramic member with an alkaline chemical solution having a pH value of not less than 10 in the presence of an ultrasonic wave, said alkaline chemical solution comprising an alkali metal hydroxide, an organic acid, a glycol solvent, a surfactant and water;

cleaning the ceramic member with an acidic chemical liquid in the presence of an ultrasonic wave after the step of cleaning with said alkaline chemical solution; and heating the ceramic member at temperatures of not less than 1,000° C. after the step of cleaning with said acidic chemical liquid.

2. The method of cleaning a ceramic member according to claim 1, further comprising the step of cleaning the ceramic member with water after the step of cleaning the ceramic member with the alkaline chemical solution and before the step of cleaning the ceramic member with the acidic chemical liquid.

* * * * *